US010245473B2

(12) United States Patent
Yamamoto

(10) Patent No.: US 10,245,473 B2
(45) Date of Patent: Apr. 2, 2019

(54) TENNIS RACKET FRAME

(71) Applicant: DUNLOP SPORTS CO. LTD., Hyogo (JP)

(72) Inventor: Yosuke Yamamoto, Hyogo (JP)

(73) Assignee: DUNLOP SPORTS CO. LTD., Hyogo (JP)

( * ) Notice: Subject to any disclaimer, the term of this patent is extended or adjusted under 35 U.S.C. 154(b) by 0 days.

(21) Appl. No.: 15/807,576

(22) Filed: Nov. 9, 2017

(65) Prior Publication Data

US 2018/0178085 A1 Jun. 28, 2018

(30) Foreign Application Priority Data

Dec. 26, 2016 (JP) ..... 2016-250397

(51) Int. Cl.
*A63B 49/02* (2015.01)
*A63B 49/10* (2015.01)

(52) U.S. Cl.
CPC ..... *A63B 49/02* (2013.01); *A63B 49/10* (2013.01); *A63B 2049/0211* (2013.01); *A63B 2049/0217* (2013.01); *A63B 2209/02* (2013.01)

(58) Field of Classification Search
CPC . A63B 49/02; A63B 49/10; A63B 2049/0201; A63B 2049/0203; A63B 2049/0204; A63B 2049/0211; A63B 2049/0217; A63B 2209/02
See application file for complete search history.

(56) References Cited

U.S. PATENT DOCUMENTS 4,919,438 A * 4/1990 Yoneeyama ..... A63B 49/02 473/536
5,014,987 A * 5/1991 Soong ..... A63B 49/02 473/537
5,071,124 A * 12/1991 Davis ..... A63B 49/02 473/537
5,080,361 A * 1/1992 Blanc ..... A63B 49/02 473/537
5,211,691 A * 5/1993 Sol ..... A63B 49/02 473/536
5,226,651 A * 7/1993 du Gardin ..... A63B 49/02 473/521
5,299,801 A * 4/1994 Sol ..... A63B 49/02 473/537
5,310,179 A * 5/1994 Takatsuka ..... A63B 49/00 473/537
5,540,434 A * 7/1996 Garrett, Jr. ..... A63B 49/02 473/536

(Continued)

FOREIGN PATENT DOCUMENTS

JP 2015150028 8/2015

*Primary Examiner* — Raleigh W Chiu
(74) *Attorney, Agent, or Firm* — JCIPRNET

(57) ABSTRACT

A racket frame has an inner thick part (28) having an outer surface (12), an inner surface (14) and a pair of middle surfaces (16) each positioned between the outer surface (12) and the inner surface (14). A thickness (Ti) of the inner surface (14) is greater than a thickness (To) of the outer surface (12). A thickness of the inner thick part (28) gradually increases toward the inside. Consequently, the middle surface (16) is inclined with respect to an X direction. A distance (Ld) between an outer end and an inner end in a thickness direction of the middle surface (16) is equal to or greater than 0.5 mm.

12 Claims, 9 Drawing Sheets

(56) References Cited

U.S. PATENT DOCUMENTS

| | | | | |
|---|---|---|---|---|
| 5,810,683 | A * | 9/1998 | Davis | A63B 49/02<br>473/546 |
| 6,383,099 | B1 * | 5/2002 | McMillan | A63B 49/02<br>473/537 |
| 2014/0256480 | A1 * | 9/2014 | Ogawa | A63B 51/00<br>473/543 |
| 2015/0224370 | A1 * | 8/2015 | Yamamoto | A63B 49/10<br>473/535 |
| 2018/0178085 | A1 * | 6/2018 | Yamamoto | A63B 49/10 |

* cited by examiner

TENNIS RACKET FRAME

CROSS-REFERENCE TO RELATED APPLICATION

This application claims the priority benefit of Japan application serial no. 2016-250397, filed on Dec. 26, 2016. The entirety of the above-mentioned patent application is hereby incorporated by reference herein and made a part of this specification.

BACKGROUND OF THE INVENTION

Field of the Invention

The present invention relates to a racket frame used for tennis. Specifically, the present invention relates to improvement of a cross-sectional shape of the frame.

Description of Related Art

A frame of a tennis racket is formed of a fiber-reinforced resin. A matrix resin of the fiber-reinforced resin is an epoxy resin. A reinforced fiber of the fiber-reinforced resin is mainly a carbon fiber. The reinforced fiber is a long fiber. A plurality of prepreg sheets are wound and an epoxy resin contained in the prepreg sheets is cured to form a frame. A racket having a frame formed of a fiber-reinforced resin is disclosed in Japanese Unexamined Patent Application Publication No. 2015-150028.

PRIOR ART DOCUMENT

Patent Documents

[Patent Document 1] Japanese Unexamined Patent Application Publication No. 2015-150028

SUMMARY OF THE INVENTION

In recent times, some senior tennis players like large ball launch angles. Further, the players like high trajectories.

In a racket having a small thickness, a contact time with a ball during a stroke tends to be long. A long contact time can contribute to a large ball launch angle. However, the racket having a small thickness is inferior in resilience performance. It is difficult for a player to strike a fast service with this racket. Further, the racket having a small thickness is inferior in stability of an orientation of a face when hitting a ball.

The present invention provides a tennis racket frame excellent in various performances.

A tennis racket frame according to the present invention is formed of a pipe. The pipe has an outer surface, an inner surface, and a pair of middle surfaces disposed each between the outer surface and the inner surface. The tennis racket frame has:

(1) an inner thick part in which the middle surfaces are inclined with respect to a ball hitting surface such that a thickness of the pipe is gradually increased inward; and (2) an outer thick part in which the middle surfaces are inclined with respect to the ball hitting surface such that the thickness of the pipe is gradually increased outward.

Preferably, the tennis racket frame further has:

(3) a uniform thickness part in which the middle surfaces are parallel to the ball hitting surface.

The tennis racket frame can be divided into a top section, a grip-side section, and a central section disposed between the top section and the grip-side section. Preferably, the top section has any of the inner thick part, the outer thick part and the uniform thickness part, and the central section has the remainder of the inner thick part, the outer thick part and the uniform thickness part.

The central section may have any of the inner thick part, the outer thick part and the uniform thickness part, and the grip side section may have the remainder of the inner thick part, the outer thick part and the uniform thickness part.

Preferably, a distance between an outer end and an inner end of the middle surface of the inner thick part in a thickness direction is 0.5 mm or more.

Preferably, a distance between an inner end and an outer end of the middle surface of the outer thick part in a thickness direction is 0.5 mm or more.

According to another viewpoint, when a tennis racket frame according to the present invention is divided into a top section, a grip-side section, and a central section disposed between the top section and the grip-side section, the central section has an inner thick part. In the inner thick part, the middle surfaces are inclined with respect to a ball hitting surface such that a thickness of the pipe is gradually increased inward.

Preferably, the top section has an outer thick part, and in the outer thick part, the middle surfaces are inclined with respect to the ball hitting surface such that a thickness of the pipe is gradually increased outward.

Preferably, the grip-side section has a uniform thickness part. In the uniform thickness part, the middle surfaces are parallel to the ball hitting surface.

Since the racket frame according to the present invention has the inner thick part, a contact time with a ball during a stroke is long. The racket frame can contribute to a large ball launch angle.

DESCRIPTION OF THE EMBODIMENTS

Hereinafter, the present invention will be described in detail on the basis of a preferred embodiment while referring to the accompanying drawings appropriately.

Figure 1:
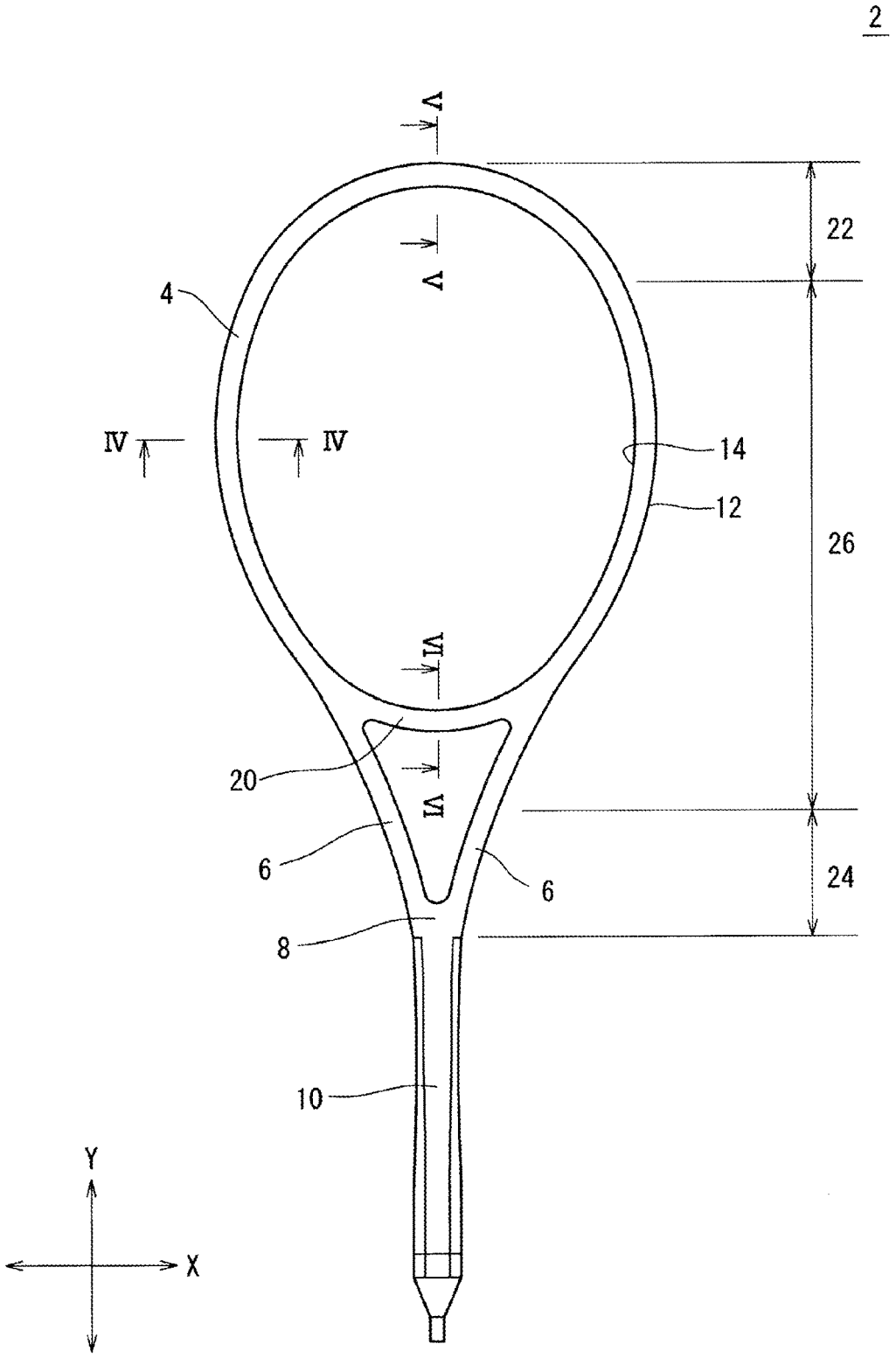
FIG. 1 is a front view showing a tennis racket frame according to an embodiment of the present invention.
Figure 2:
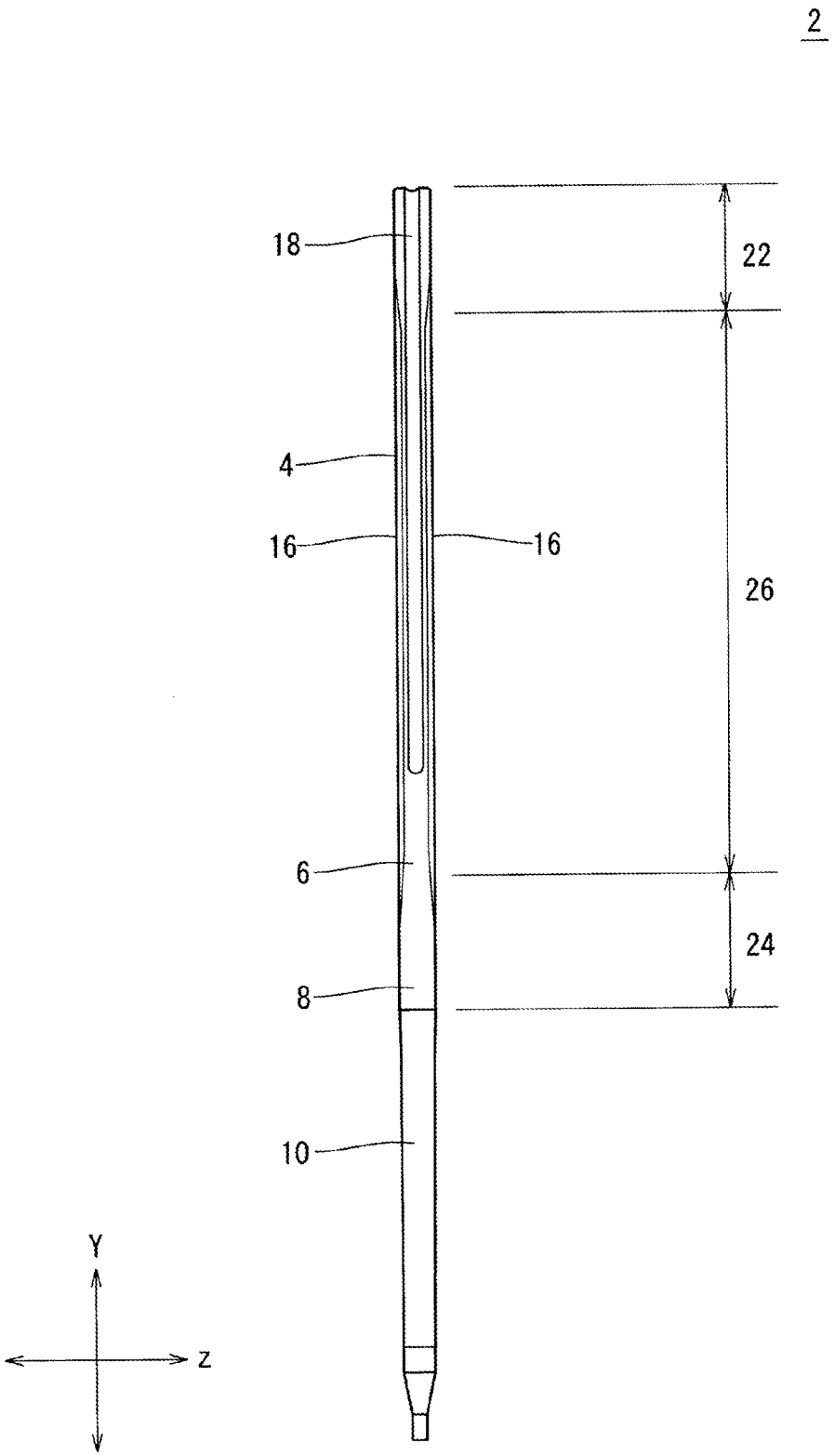
FIG. 2 is a right side view showing the tennis racket frame of FIG. 1.
Figure 3:
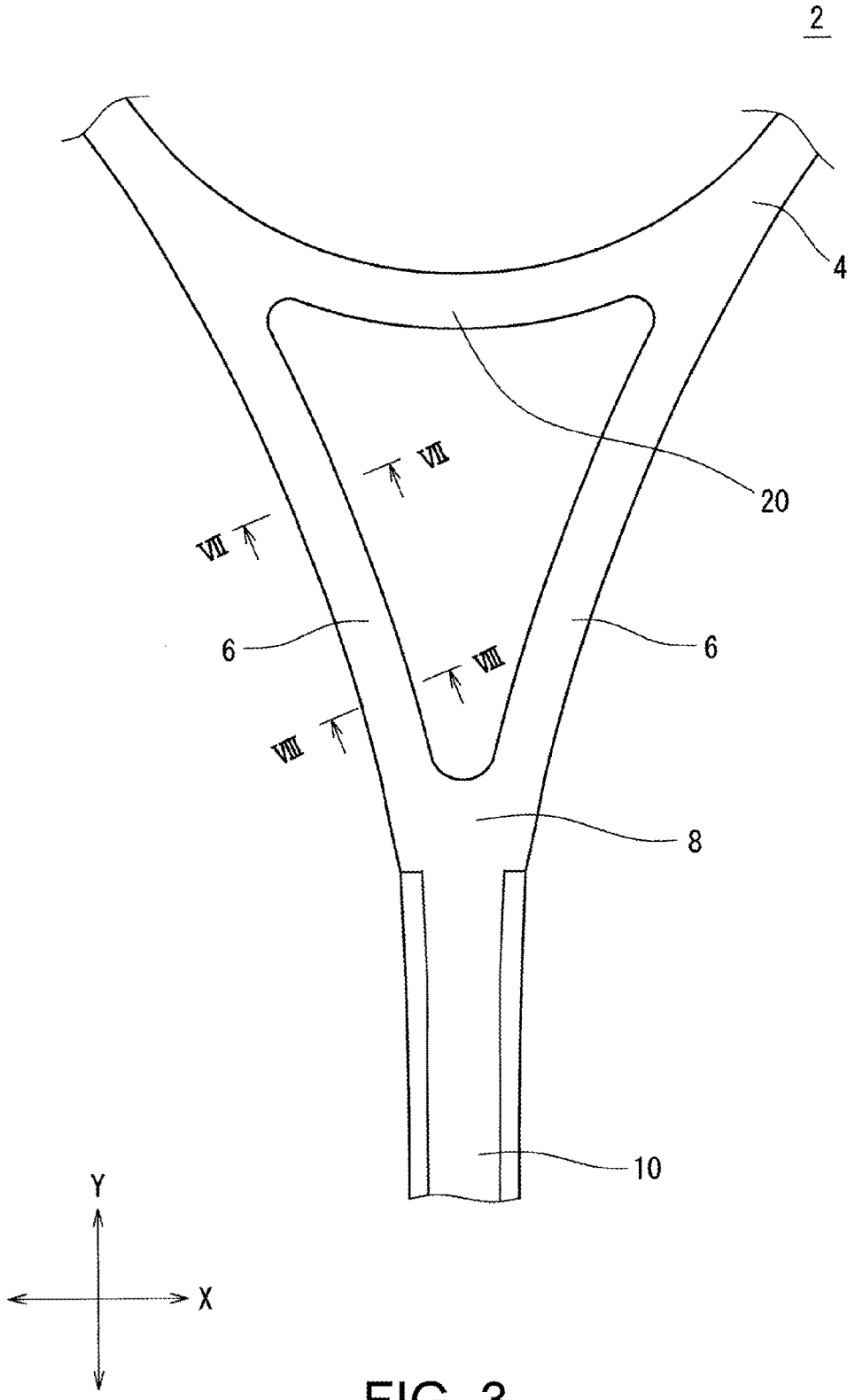
FIG. 3 is an enlarged view showing a portion of the tennis racket frame of FIG. 1.

In FIGS. 1 to 3, a racket frame 2 used for tennis played with regulation balls is shown. The racket frame 2 includes a head 4, two throats 6, a shaft 8 and a grip 10. A grommet, a grip tape, an end cap, and so on, are attached to the racket frame 2. Further, a string is stretched in the racket frame 2. In FIG. 1, a direction shown by an arrow X is a widthwise direction of the racket frame 2, and a direction shown by an arrow Y is an axial direction of the racket frame 2. In FIG. 2, a direction shown by an arrow Z is a thickness direction of the racket frame 2. In the racket obtained from the racket frame 2, a ball hitting surface is parallel to an X-Y plane.

The racket frame 2 is formed of a pipe. In other words, the racket frame 2 is hollow. The pipe has an outer surface 12, an inner surface 14 and a pair of middle surfaces 16. A material of the pipe is a fiber-reinforced resin. A matrix resin of the fiber-reinforced resin is a thermoset resin. A typical thermoset resin is an epoxy resin. A typical fiber of the fiber-reinforced resin is a carbon fiber. The fiber is a long fiber.

The head 4 forms a contour of a ball hitting surface. A front surface shape of the head 4 is substantially an ellipse. A major-axis direction of the ellipse coincides with the axial direction Y of the racket frame 2. A minor-axis direction of the ellipse coincides with the widthwise direction X of the racket frame 2. The outer surface 12 of the head 4 has a gut groove 18. As shown in FIG. 2, the gut groove 18 extends in a circumferential direction of the head 4. The grommet (not shown) is fitted into the gut groove 18.

One end of each of the throats 6 is connected to the head 4. The throat 6 joins at the other throat 6 in the vicinity of the other ends. The throats 6 extend from the head 4 to reach the shaft 8. The shaft 8 extends from a place to which the two throats 6 join. The shaft 8 is formed continuously and integrally with the throats 6. The grip 10 is formed continuously and integrally with the shaft 8. A portion of the head 4 sandwiched between the two throats 6 is a yoke 20.

As shown in FIG. 1, the racket frame 2 except for the grip 10 can be divided into a top section 22, a grip-side section 24 and a central section 26. The central section 26 is disposed between the top section 22 and the grip-side section 24. The top section 22 includes a portion of the head 4. The central section 26 includes a portion of the head 4 and portions of the throats 6. The grip-side section 24 includes portions of the throats 6 and a portion of the shaft 8.

Figure 4:
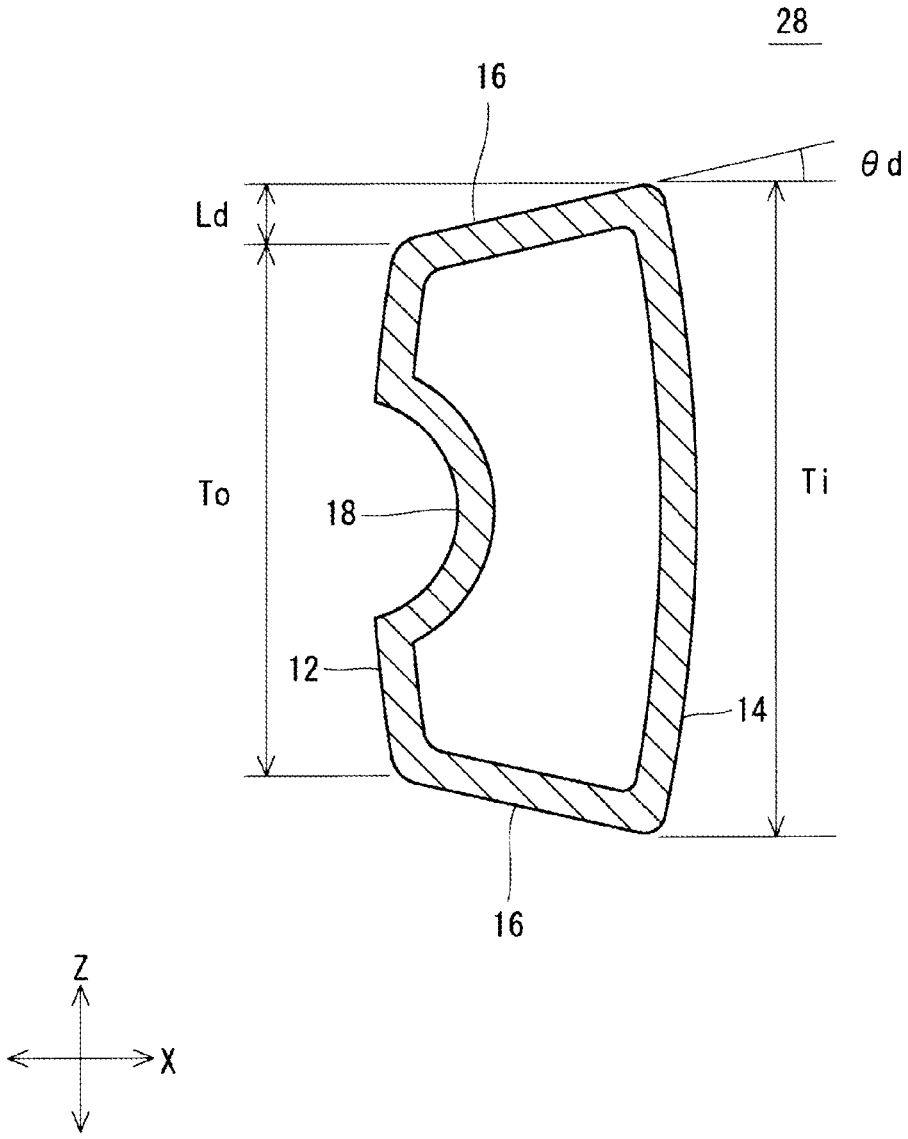
FIG. 4 is an enlarged cross-sectional view taken along line IV-IV of FIG. 1.

FIG. 4 is an enlarged cross-sectional view taken along line IV-IV of FIG. 1. In FIG. 4, a portion of the head 4 belonging to the central section 26 is shown. In FIG. 4, the outer surface 12, the inner surface 14 and the pair of middle surfaces 16 are shown. The middle surfaces 16 are disposed between the outer surface 12 and the inner surface 14. The outer surface 12 has the gut groove 18.

As shown in FIG. 4, a thickness Ti of the inner surface 14 is larger than a thickness To of the outer surface 12. The thickness of the pipe is gradually increased inward. Accordingly, the middle surfaces 16 are inclined with respect to the X direction. In other words, the middle surfaces 16 are inclined with respect to the ball hitting surface. In the present invention, a portion in which the thickness Ti of the inner surface 14 is larger than the thickness To of the outer surface 12 is referred to as an inner thick part 28.

The inner thick part 28 is present mainly in the central section 26. Bending rigidity of the inner thick part 28 is low. When a ball is hit by the racket having the inner thick part 28, the racket frame 2 is sufficiently deformed. A long contact time between the racket and the ball can be achieved by the deformation. A player who uses the racket can strike a ball with a large ball launch angle. The large ball launch angle causes a high trajectory. The large ball launch angle further shifts a position of an apex of the trajectory to a position close to a baseline of an opponent. The trajectory enables a player to achieve an advantage in the game. Moreover, sufficient deformation of the racket frame 2 can also contribute to a soft feeling of hitting the ball.

Figure 5:
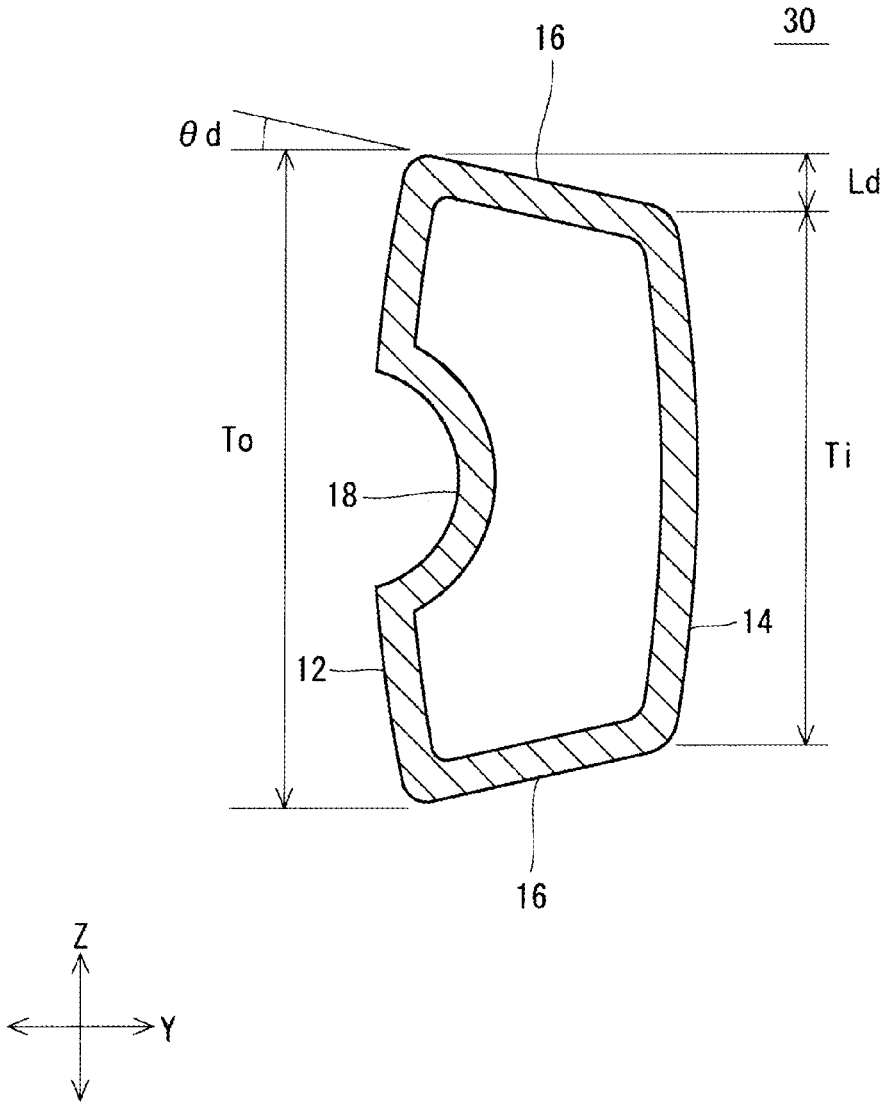
FIG. 5 is an enlarged cross-sectional view taken along line V-V of FIG. 1.

FIG. 5 is an enlarged cross-sectional view taken along line V-V of FIG. 1. In FIG. 5, a portion of the head 4 belonging to the top section 22 is shown. In FIG. 5, the outer surface 12, the inner surface 14 and the pair of middle surfaces 16 are shown. The middle surfaces 16 are disposed between the outer surface 12 and the inner surface 14. The outer surface 12 has the gut groove 18.

As shown in FIG. 5, a thickness To of the outer surface 12 is larger than a thickness Ti of the inner surface 14. The thickness of the pipe is gradually increased outward. Accordingly, the middle surfaces 16 are inclined with respect to the Y direction. In other words, the middle surfaces 16 are inclined with respect to the ball hitting surface. In the present invention, a portion in which the thickness To of the outer surface 12 is larger than the thickness Ti of the inner surface 14 is referred to as an outer thick part 30.

The outer thick part 30 is present mainly in the top section 22. The outer thick part 30 has low bending rigidity when a low load is applied but high bending rigidity when a high load is applied. The outer thick part 30 can contribute to resilience when a stroke is at a high speed. The outer thick part 30 can also contribute to resilience when a ball is served. Further, the outer thick part 30 can also contribute to stability in an orientation of a face when hitting.

In the racket frame 2, since the central section 26 mainly has the inner thick part 28 and the top section 22 mainly has the outer thick part 30, a long contact time and resilience are compatible.

The racket frame 2 may include the head 4 that does not have the outer thick part 30. Even in this case, a long contact time which is an effect of the inner thick part 28 is achieved.

Figure 6:
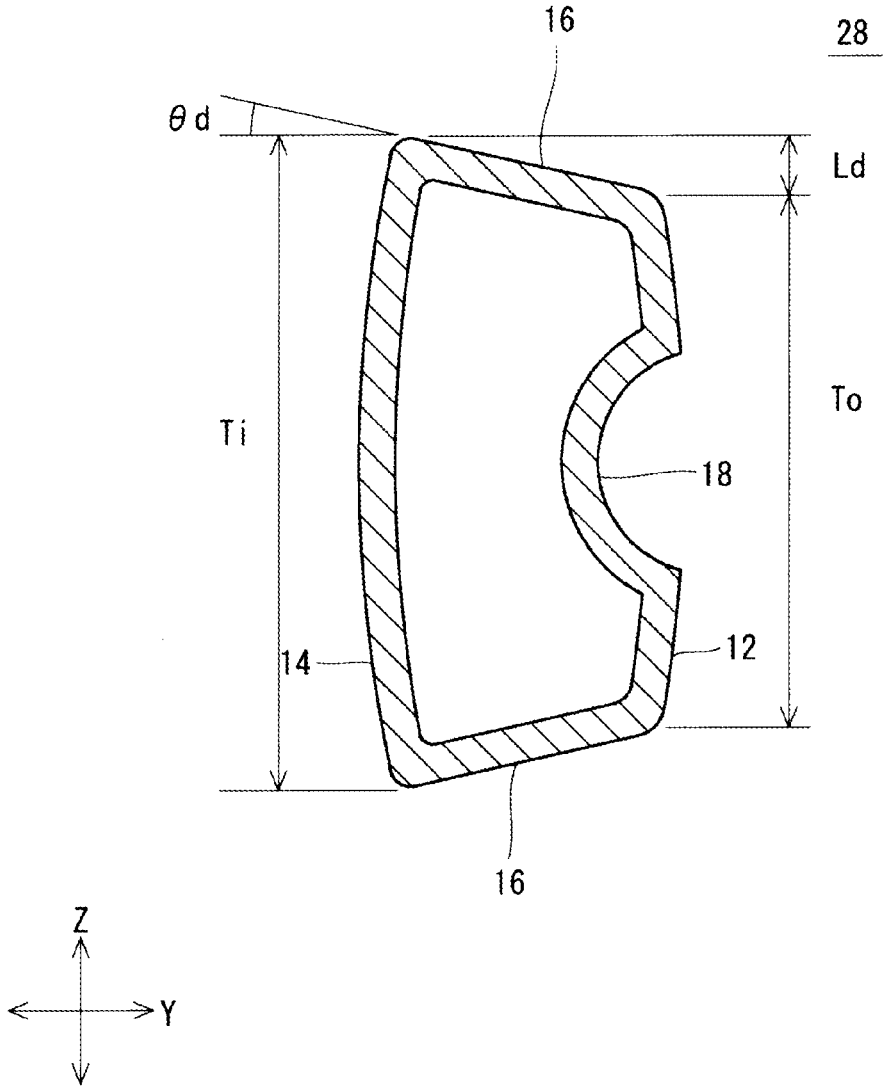
FIG. 6 is an enlarged cross-sectional view taken along line VI-VI of FIG. 1.

FIG. 6 is an enlarged cross-sectional view taken along line VI-VI of FIG. 1. In FIG. 6, the yoke 20 is shown. As will be apparent from FIG. 1, the yoke 20 belongs to the central section 26. In FIG. 6, the outer surface 12, the inner surface 14 and the pair of middle surfaces 16 are shown. The middle surfaces 16 are disposed between the outer surface 12 and the inner surface 14. The outer surface 12 has the gut groove 18.

As shown in FIG. 6, a thickness Ti of the inner surface 14 is larger than a thickness To of the outer surface 12. The thickness of the pipe is gradually increased inward. Accordingly, the middle surfaces 16 are inclined with respect to the Y direction. In other words, the middle surfaces 16 are inclined with respect to the ball hitting surface.

A portion shown in FIG. 6 is the inner thick part 28. Bending rigidity of the inner thick part 28 is low. When a ball is hit by the racket having the inner thick part 28, the racket frame 2 is sufficiently deformed. A long contact time between the racket and the ball can be achieved by the deformation. A player who uses the racket can hit a ball with a large ball launch angle. The large ball launch angle causes a high trajectory. The large ball launch angle further shifts a position of an apex of a trajectory to a position close to a baseline of an opponent. The trajectory enables a player to achieve an advantage in the game. Moreover, sufficient deformation of the racket frame 2 can also contribute to a soft feeling of hitting the ball. The head 4 may include the yoke 20 that does not have the inner thick part 28.

Figure 7:
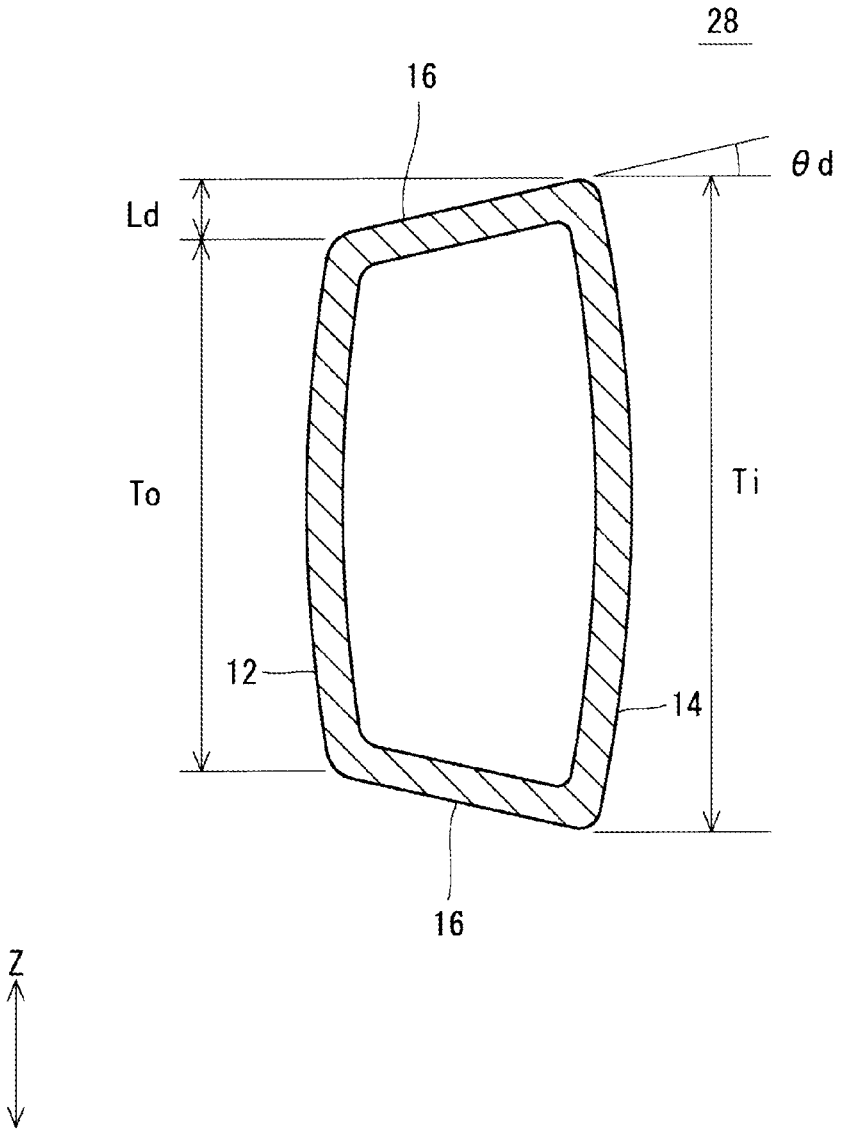
FIG. 7 is an enlarged cross-sectional view taken along line VII-VII of FIG. 3.

FIG. 7 is an enlarged cross-sectional view taken along line VII-VII of FIG. 3. In FIG. 7, a portion of the throat 6 close to the head 4 is shown. As will be apparent from FIGS. 1 and 3, a portion shown in FIG. 7 belongs to the central section 26. In FIG. 7, the outer surface 12, the inner surface 14 and the pair of middle surfaces 16 are shown. The middle surfaces 16 are disposed between the outer surface 12 and the inner surface 14. The outer surface 12 does not have the gut groove 18.

As shown in FIG. 7, a thickness Ti of the inner surface 14 is larger than a thickness To of the outer surface 12. The thickness of the pipe is gradually increased inward. Accordingly, the middle surfaces 16 are inclined with respect to a left/right direction of FIG. 7. In other words, the middle surfaces 16 are inclined with respect to the ball hitting surface.

A portion shown in FIG. 7 is the inner thick part 28. Bending rigidity of the inner thick part 28 is low. When a ball is hit by the racket having the inner thick part 28, the racket frame 2 is sufficiently deformed. A long contact time between the racket and the ball can be achieved by the deformation. A player who uses the racket can hit a ball with a large ball launch angle. The large ball launch angle causes a high trajectory. The large ball launch angle further shifts a position of an apex of the trajectory to a position close to a baseline of an opponent. The trajectory enables a player to achieve an advantage in the game. Moreover, sufficient deformation of the racket frame 2 can also contribute to a soft feeling of hitting the ball. The head 4 may include the throats 6 that do not have the inner thick part 28.

Figure 8:
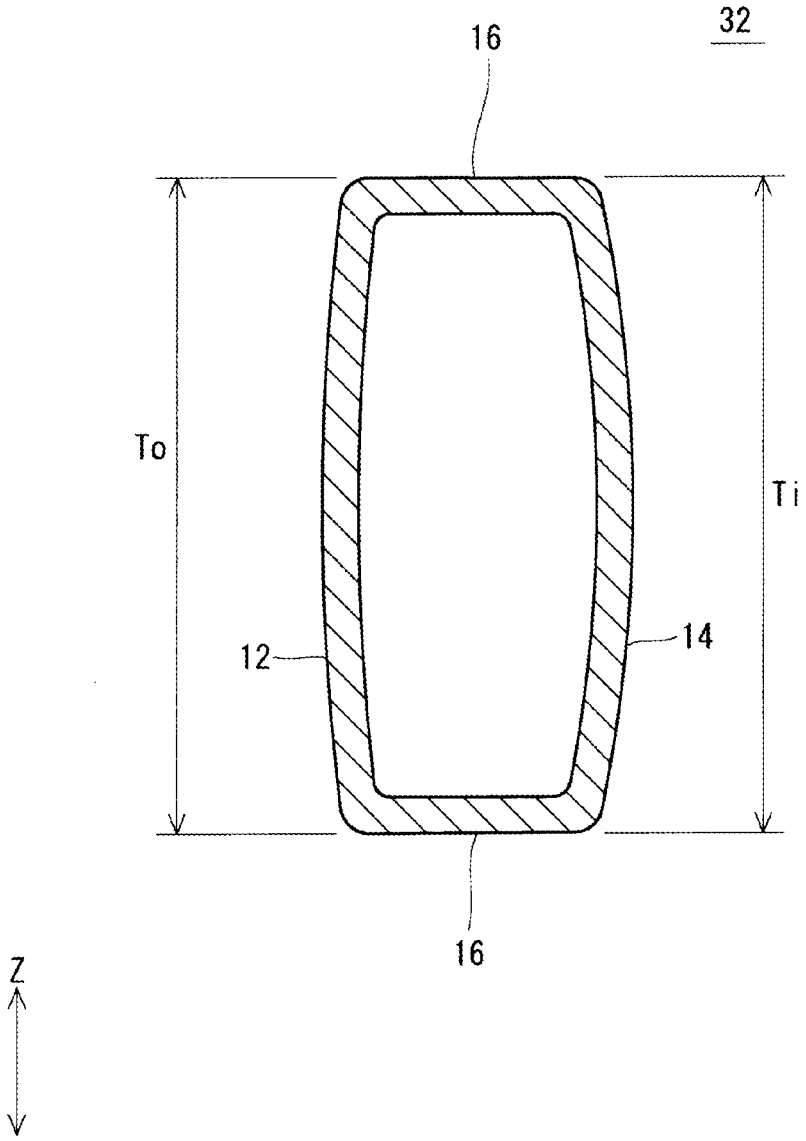
FIG. 8 is an enlarged cross-sectional view taken along line VIII-VIII of FIG. 3.

FIG. 8 is an enlarged cross-sectional view taken along line VIII-VIII of FIG. 3. In FIG. 8, a portion of the throat 6 close to the shaft 8 is shown. As will be apparent from FIGS. 1 and 3, a portion shown in FIG. 8 belongs to the grip-side section 24. In FIG. 8, the outer surface 12, the inner surface 14 and the pair of middle surfaces 16 are shown. The middle surfaces 16 can be disposed between the outer surface 12 and the inner surface 14. The outer surface 12 does not have the gut groove 18.

As shown in FIG. 8, a thickness Ti of the inner surface 14 is equal to a thickness To of the outer surface 12. Accordingly, the middle surfaces 16 extend in the left/right direction of FIG. 8. In other words, the middle surfaces 16 are parallel to a ball hitting surface. In the present invention, a portion in which the thickness Ti of the inner surface 14 is equal to the thickness To of the outer surface 12 is referred to as a uniform thickness part 32. Bending rigidity of the uniform thickness part 32 is high. The uniform thickness part 32 contributes to resilience. The uniform thickness part 32 can further contribute to stability in an orientation of the face.

The racket frame 2 may include the head 4 that does not have the uniform thickness part 32. Even in this case, a long contact time which is an effect of the inner thick part 28 can be achieved.

Figure 9:
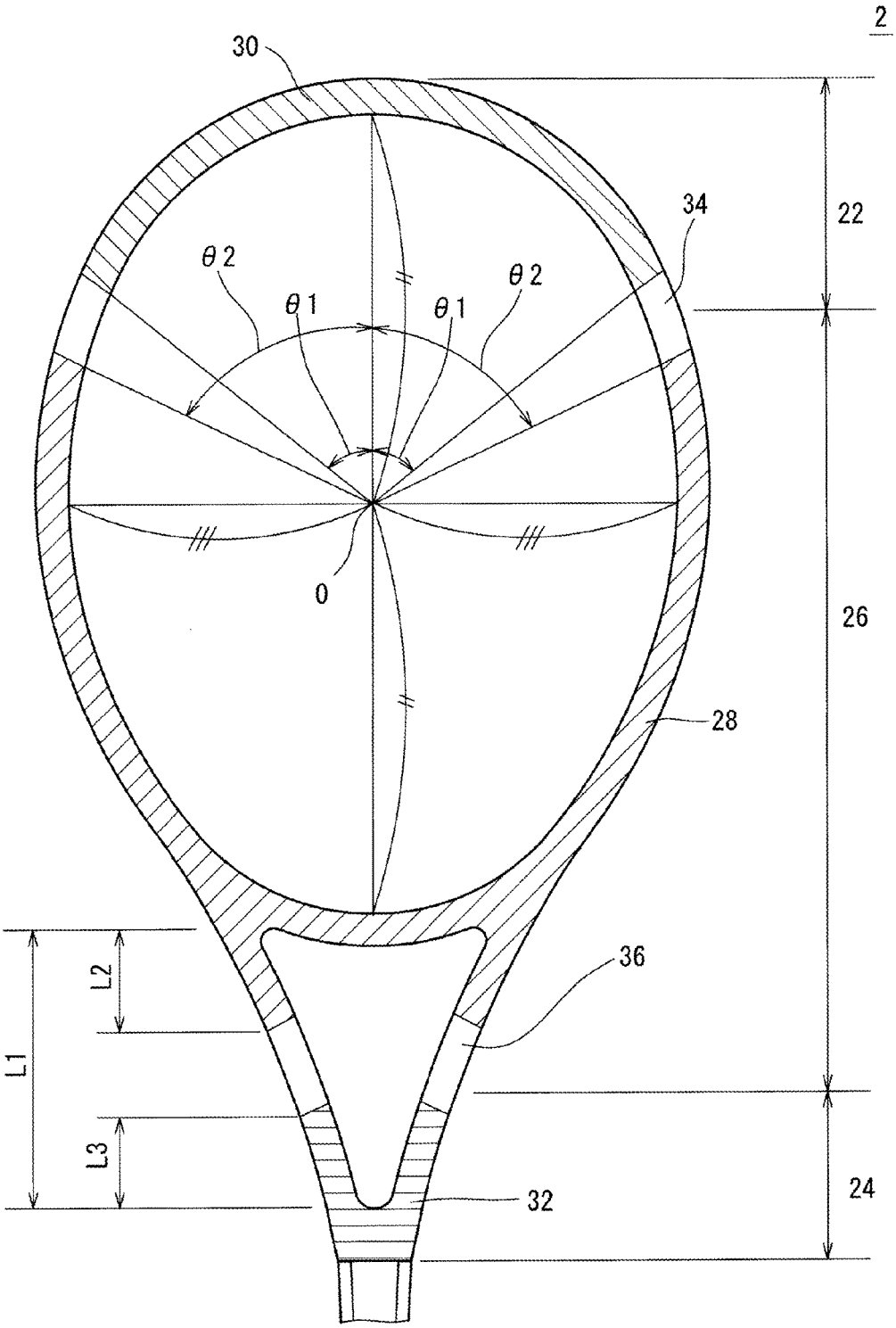
FIG. 9 is an enlarged view showing a portion of the tennis racket frame of FIG. 1.

FIG. 9 is an enlarged view showing a portion of the tennis racket frame 2 of FIG. 1. In FIG. 9, a region hatched by leftward/upward lines is the outer thick part 30, a region hatched by rightward/upward lines is the inner thick part 28, and a region hatched by lateral lines is the uniform thickness part 32. A region disposed between the outer thick part 30 and the inner thick part 28 is a first transition zone 34. A region between the inner thick part 28 and the uniform thickness part 32 is a second transition zone 36. In the first transition zone 34, a cross-sectional shape thereof is gradually changed to the shape shown in FIG. 4 from the shape shown in FIG. 5. In the second transition zone 36, a cross-sectional shape thereof is gradually changed to the shape shown in FIG. 8 from the shape shown in FIG. 7.

In FIG. 9, an angle designated by reference sign θ1 is a central angle from a top-most vertex to a boundary between the outer thick part 30 and the first transition zone 34. From the viewpoint of resilience and stability of an orientation of a face, the angle θ1 is preferably 30° or more and, in particular, preferably 40° or more. From the viewpoint that the inner thick part 28 can be sufficiently increased, the angle θ1 is preferably 85° or less and, in particular, 75° or less.

An angle designated by reference sign θ2 in FIG. 9 is a central angle from a top-most vertex to a boundary between the first transition zone 34 and the inner thick part 28. From the viewpoint of a long contact time with a ball, the angle θ2 is preferably 90° or less and, in particular, preferably 80° or less. From the viewpoint that the outer thick part 30 can be sufficiently increased, the angle θ2 is preferably 40° or more and, in particular, 50° or more.

A length represented by an arrow L2 in FIG. 9 is a length of the inner thick part 28 in the throat 6. The length L2 is measured in the axial direction. From the viewpoint of a long contact time with a ball, a ratio (L2/L1) of the length L2 with respect to a length L1 of the throat 6 is preferably 0.2 or more and, in particular, preferably 0.3 or more. From the viewpoint that the uniform thickness part 32 can be sufficiently increased, the ratio (L2/L1) is preferably 0.7 or less and, in particular, preferably 0.6 or less.

A length represented by an arrow L3 in FIG. 9 is a length of the uniform thickness part 32 in the throat 6. The length L3 is measured in the axial direction. From the viewpoint of resilience and stability of an orientation of a face, a ratio (L3/L1) of the length L3 with respect to the length L1 of the throat 6 is preferably 0.2 or more and, in particular, preferably 0.3 or more. From the viewpoint that the inner thick part 28 can be sufficiently increased, the ratio (L3/L1) is preferably 0.7 or less and, in particular, preferably 0.6 or less.

A distance represented by an arrow Ld in FIGS. 4 to 7 is a distance between the outer end and the inner end of the middle surfaces 16 in a thickness direction. From the viewpoint of balance of various performances, the distance Ld is preferably 0.5 mm or more and, in particular, preferably 0.8 mm or more. From the viewpoint of balance of various performances, the distance Ld is preferably 3.0 mm or less and, in particular, preferably 2.0 mm or less.

In each area of the racket frame, the larger thickness among the thickness Ti of the inner surface 14 and the thickness To of the outer surface 12 is preferably 20 mm or more and 30 mm or less and, in particular, preferably 22 mm or more and 26 mm or less.

An angle designated by reference sign θd in FIGS. 4 to 7 is an inclined angle of the middle surfaces 16. From the viewpoint of balance of various performances, the angle θd is preferably 3° or more and, in particular, preferably 5° or more. From the viewpoint of balance of various performances, the angle θd is preferably 30° or less and, in particular, preferably 20° or less.

In the racket frame 2 according to the present invention, the distribution of rigidity can be adjusted by devising the cross-sectional shape. Accordingly, there is no need to use a specific material (prepreg) in adjustment of the distribution of rigidity. In the racket frame, the distribution of rigidity can be adjusted conveniently at low cost. Of course, a specific material may be used in the racket frame 2.

Various modifications may be made in the cross-sectional shape of the racket frame. Since the inner thick part is present at any position in the racket frame and the outer thick part is present at the other position, a long contact time and resilience are compatible.

When the top section has the inner thick part, the central section preferably has an outer thick part or a uniform thickness part. When the top section has the outer thick part, the central section preferably has the inner thick part or the uniform thickness part. When the top section has a uniform thickness part, the central section preferably has the inner thick part or the outer thick part.

When the central section has the inner thick part, the grip-side section preferably has the outer thick part or the uniform thickness part. When the central section has the outer thick part, the grip-side section preferably has the inner thick part or the uniform thickness part. When the central section has the uniform thickness part, the grip-side section preferably has the inner thick part or the outer thick part.

Embodiment

Hereinafter, while the effects of the present invention are clarified by an example, the present invention should not be interpreted restrictively on the basis of the description of the example.

Example

The racket frame shown in FIGS. 1 to 9 was formed. A thickness of the racket frame is as follows.

Outer Thick Part of Top Section

Thickness To of outer surface: 22 mm

Thickness Ti of inner surface: 20 mm

Inner Thick Part of Central Section

Thickness To of outer surface: 20 mm

Thickness Ti of inner surface: 22 mm

Uniform Thickness Section of Grip-Side Section

Thickness To of outer surface: 21 mm

Thickness Ti of inner surface: 21 mm

Comparative Example

A commercially available racket frame was prepared. A thickness of the racket frame is as follows.

Top Section

Thickness To of outer surface: 21 mm

Thickness Ti of inner surface: 21 mm

Central Section

Thickness To of outer surface: 21 mm

Thickness Ti of inner surface: 21 mm

Grip-Side Section

Thickness To of outer surface: 21 mm

Thickness Ti of inner surface: 21 mm

[Rally]

A grommet, a string, and so on, were attached to the racket frame to obtain a racket. A rally was performed by players with the rackets. The trajectory was tracked and measured, and an average value of an average value of a ball launch angle of a ball and a horizontal distance from a stroke point to an apex of the trajectory was calculated. A result thereof is shown in the following Table 1.

[Service]

Services were performed by players using the rackets and speeds of balls were measured. Averages of the results obtained by multiple measurements are represented in the following Table 1.

TABLE 1

Estimated Results

| | | Example | Comparative Example |
|---|---|---|---|
| Player A | Launch angle (degree) | 3.36 | 2.61 |
| | Distance to apex (m) | 7.19 | 6.74 |
| | Speed of service (km/h) | 156.3 | 154.7 |
| Player B | Launch angle (degree) | 3.99 | 3.70 |
| | Distance to apex (m) | 8.01 | 7.33 |
| | Speed of service (km/h) | 167.7 | 161.6 |

As shown in Table 1, the racket of the example is superior in performance. From the evaluation results, the superiority of the present invention is obvious.

The racket according to the present invention is suitable for professional players participating in tours and is also suitable for amateur players.

What is claimed is:

1. A tennis racket frame formed of a pipe having an outer surface, an inner surface, and a pair of middle surfaces each disposed between the outer surface and the inner surface, the tennis racket frame comprising:

an inner thick part in which the middle surfaces are inclined with respect to a ball hitting surface such that a thickness of the pipe is gradually increased inward;

an outer thick part in which the middle surfaces are inclined with respect to the ball hitting surface such that the thickness of the pipe is gradually increased outward, and a uniform thickness part in which the middle surfaces are parallel to the ball hitting surface.

2. The tennis racket frame according to claim 1, wherein, when the tennis racket frame is divided into a top section, a grip-side section, and a central section disposed between the top section and the grip-side section, the top section has any of the inner thick part, the outer thick part and the uniform thickness part, and the central section has the remainder of the inner thick part, the outer thick part and the uniform thickness part.

3. The tennis racket frame according to claim 2, wherein a distance between an outer end and an inner end of the middle surface of the inner thick part in a thickness direction is 0.5 mm or more.

4. The tennis racket frame according to claim 2, wherein a distance between an inner end and an outer end of the middle surface of the outer thick part in a thickness direction is 0.5 mm or more.

5. The tennis racket frame according to claim 1, wherein, when the tennis racket frame is divided into a top section, a grip-side section, and a central section disposed between the top section and the grip-side section, the central section has any of the inner thick part, the outer thick part and the uniform thickness part, and the grip-side section has the remainder of the inner thick part, the outer thick part and the uniform thickness part.

6. The tennis racket frame according to claim 5, wherein a distance between an outer end and an inner end of the middle surface of the inner thick part in a thickness direction is 0.5 mm or more.

7. The tennis racket frame according to claim 5, wherein a distance between an inner end and an outer end of the middle surface of the outer thick part in a thickness direction is 0.5 mm or more.

8. The tennis racket frame according to claim 1, wherein a distance between an outer end and an inner end of the middle surface of the inner thick part in a thickness direction is 0.5 mm or more.

9. The tennis racket frame according to claim 8, wherein a distance between an inner end and an outer end of the middle surface of the outer thick part in a thickness direction is 0.5 mm or more.

10. The tennis racket frame according to claim 1, wherein a distance between an inner end and an outer end of the middle surface of the outer thick part in a thickness direction is 0.5 mm or more.

11. A tennis racket frame formed of a pipe having an outer surface, an inner surface, and a pair of middle surfaces each disposed between the outer surface and the inner surface, wherein the tennis racket frame is divided into a top section, a grip-side section, and a central section disposed between the top section and the grip-side section, the central section has an inner thick part, and in the inner thick part, the middle surfaces are inclined with respect to a ball hitting surface such that a thickness of the pipe is gradually increased inward the grip-side section has a uniform thickness part, and in the uniform thickness part, the middle surfaces are parallel to the ball hitting surface.

12. The tennis racket frame according to claim 11, wherein the top section has an outer thick part, and in the outer thick part, the middle surfaces are inclined with respect to the ball hitting surface such that a thickness of the pipe is gradually increased outward.

* * * * *